US007685653B2

(12) United States Patent
Kovacs

(10) Patent No.: US 7,685,653 B2
(45) Date of Patent: Mar. 30, 2010

(54) ODOR EXTRACTION SYSTEM WITH FLUID TANK VALVE

(76) Inventor: Gyorgy Kovacs, Attila út 3., H-9023 Győr (HU)

( * ) Notice: Subject to any disclaimer, the term of this patent is extended or adjusted under 35 U.S.C. 154(b) by 215 days.

(21) Appl. No.: 10/558,465

(22) Filed: Nov. 28, 2005

(65) Prior Publication Data

US 2007/0017010 A1 Jan. 25, 2007

(30) Foreign Application Priority Data

May 28, 2003 (HU) ..... 0400073

(51) Int. Cl.
*E03D 9/04* (2006.01)

(52) U.S. Cl. ..... 4/213; 4/219

(58) Field of Classification Search ..... 4/209 R, 4/213, 214, 216, 348–349
See application file for complete search history.

(56) References Cited

U.S. PATENT DOCUMENTS

| | | | | |
|---|---|---|---|---|
| 1,424,955 A * | 8/1922 | Van Eck | ..... | 4/213 |
| 2,449,134 A * | 9/1948 | Majauskas | ..... | 4/213 |
| 5,388,280 A * | 2/1995 | Sim | ..... | 4/213 |
| 5,704,074 A * | 1/1998 | Baldea | ..... | 4/213 |
| 5,781,937 A | 7/1998 | Liang | | |

FOREIGN PATENT DOCUMENTS

| | | |
|---|---|---|
| DE | 3439587 | 4/1986 |
| DE | 19651076 | 12/1996 |
| GB | 2237825 | 5/1991 |
| IT | 202798 | 2/1939 |

* cited by examiner

*Primary Examiner*—Tuan N Nguyen
(74) *Attorney, Agent, or Firm*—Brooks Kushman P.C.

(57) ABSTRACT

Odor extraction system having a fluid tank valve, for extracting malodorous air from a toilet bowl and preventing discharge into the environment, a fan connected to the shaft of an electric motor disposed in a pipe chamber that is located between the free end of a suction piece and an outlet piece, where said suction piece is adapted for connecting to the flush pipe of the toilet bowl and where said outlet piece is joined to the sewer pipe, with said pipe chamber fluid tank valve adapted for airtight closure. The fluid tank valve is part of the pipe chamber, the fluid tank of the fluid tank valve having a suction opening and an outlet opening, with a closing mechanism joined to said suction opening, having a free end at the downstream extremity thereof, with said free end submerging into the fluid in the fluid tank with the free end rising from said fluid under the effect of pressure difference.

2 Claims, 1 Drawing Sheet

ODOR EXTRACTION SYSTEM WITH FLUID TANK VALVE

The object of the Invention is an odour extraction system with fluid tank valve that is connected into the drainage system and can be applied for removing malodorous air from a toilet bowl to prevent bad odours from escaping into the environment.

The document DE 3439587 describes a solution for cleaning the air of toilet cubicles that comprises the steps of removing odorous air from the toilet bowl by air extraction, and passing It through the toilet siphon into the sewerage system. Gases are prevented from flowing back from the sewer pipe by means of a check valve.

One of the drawbacks of this solution is that the closure of the check valve is incomplete due to the small closing force. Because of the relatively small pressure difference, the weight of the flap applied in the check valve cannot be set too high or else the valve could not be opened. Closure of the check valve is also impeded by scale formation in the humid environment of the system and by other material possibly getting stuck between the closing surfaces of the valve. Incomplete closure results in sewage gases entering the environment after the extraction system has been stopped.

Hungarian utility model HU U 9500255 proposes a solution for odour extraction with the application of an extraction system disposed in the toilet bowl, by directing gases extracted from the toilet bowl into the drainage system. Similarly to the above cited document, sewage gases are prevented from reflowing by means of check valves. The document discloses two embodiments of the check valve, the difference between the two versions being that in the first case the valve is closed by Its own weight, whereas in the second embodiment the closing element is a spring-actuated ball.

The drawback of the utility model is that the closing weight or spring force cannot be high or else the relatively small force yielded by the small pressure difference is not sufficient for actuating the valve. In a short time the closure of the valve becomes incomplete and bad odour laden air can continuously flow from the sewer pipe into the toilet cubicle. Therefore the odour extraction system may in fact turn into a "malodorizer" system.

The aim of the present invention is to provide an air handling system with fluid tank valve for extracting malodorous air from the site of occurrence of the bad odours, that is, from the toilet bowl and directing it through the unidirectional fluid tank valve into the sewer pipe in such a way that gases cannot flow from the sewer into the toilet cubicle even after the fan has stopped. The fluid tank valve lets gases through into the ventilated direction but shuts off the connection between the sewer and the toilet space after the fan has stopped. Thus the air in the toilet cubicle remains free from bad odours, which makes it more pleasant to use the facility.

An important feature of the configuration according to the invention is that the suction piece is joined to the flush pipe of the toilet at the toilet bowl (the place of occurrence of bad odours) in such a way that airstreams induced by the odour extraction may prevent bad odours from entering into the environment and flushing water may supplement the fluid that has been lost from the tank of the fluid tank valve due to evaporation.

The most important and essential feature of the system according to the invention is that the fluid tank valve is opened after the fan has been turned on but before the source of bad odours appears, with the extraction of air being carried on until the odour source is removed. After the air extraction process has been completed the fluid tank valve returns to its original closed position and thereby prevents sewage gases from entering the toilet cubicle.

The inventive system is triggered to turn on and off by mechanical, electric, electronic, optical or acoustic signals, or using a timer.

The present invention is therefore an odour extraction system comprising a fluid tank valve, primarily for extracting malodorous air from a toilet bowl and preventing bad odours from getting into the environment, comprising a fan connected to the shaft of an electric motor, said fan being disposed in a pipe chamber that is located between the free end of a suction piece and an outlet piece, where said suction piece is adapted for connecting to the flush pipe of the toilet bowl and where said outlet piece is hermetically joined to the sewer pipe, with said pipe chamber comprising a fluid tank valve adapted for airtight closure. The fluid tank valve is implemented as part of the pipe chamber, where the fluid tank of the fluid tank valve comprises a suction opening and an outlet opening, with a closing means being hermetically joined to said suction opening, said closing means comprising a free end at the downstream extremity thereof, with said free end submerging into the fluid in the fluid tank and with said free end rising from said fluid under the effect of pressure difference.

According to a preferred embodiment of the invention the fluid tank thereof comprises a levelling pipe providing communication between the fluid and the suction opening and a float for preventing the outflow of the fluid through the outlet opening.

The invention will now be further explained referring to the following drawings that show a preferred embodiment of the inventive odour extraction system with fluid tank valve, applicable primarily for removing polluted air from a toilet bowl and thereby preventing bad odours from escaping into the environment.

Figure 1:
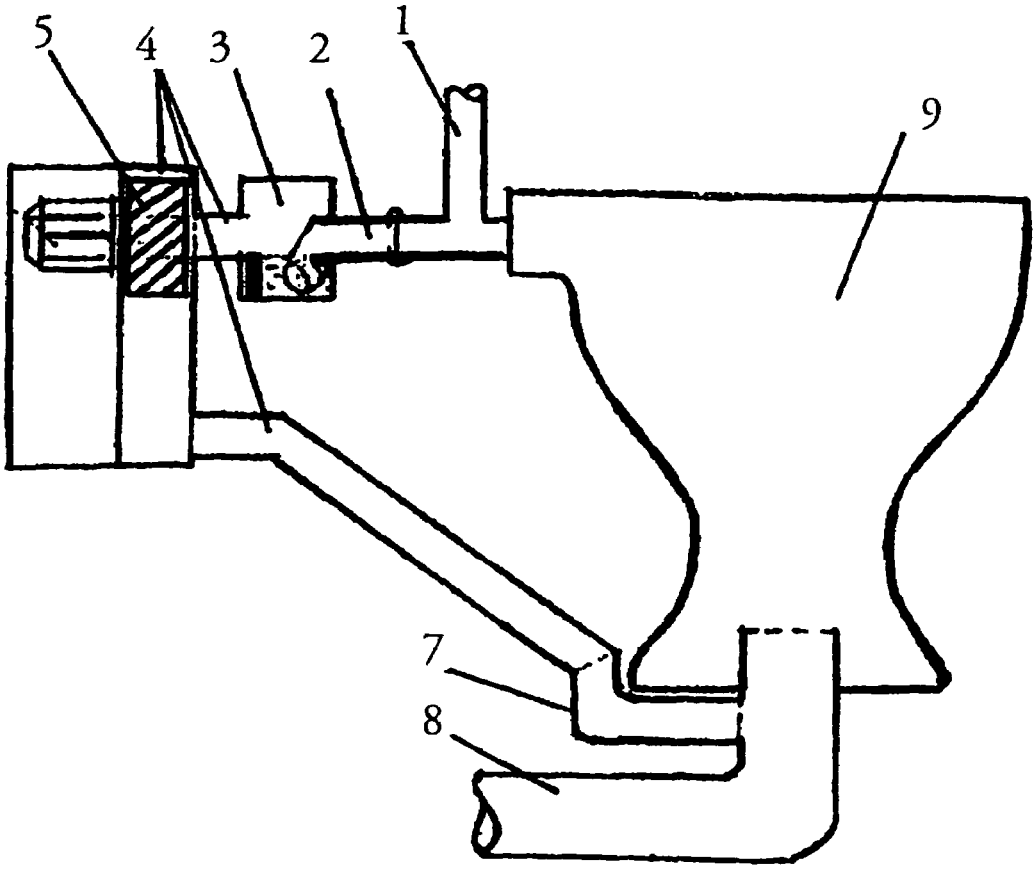
FIG. 1 is a schematic view of the inventive odour extraction system.
Figure 2:
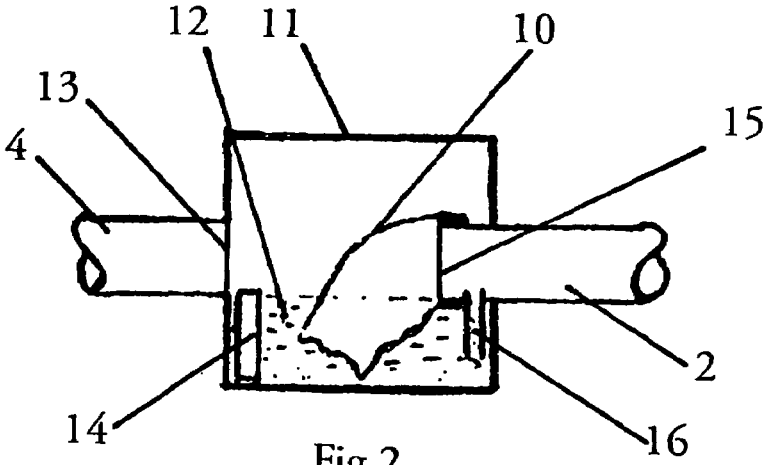
FIG. 2 shows a larger-scale view of the fluid tank valve applied in the invention.

The fan 5 of the inventive odour extraction system is disposed in a pipe chamber 4 and is connected to the shaft of an electric motor 6. The inlet of the pipe chamber is a suction piece 2, with the free end of said suction piece 2 being implemented such that it can be fitted to the flush pipe 1 of the toilet bowl 9. An outlet piece 7 is located at the outlet end of the pipe chamber 4, said outlet piece 7 being hermetically joined to the sewer pipe 8. A fluid tank valve 3 is disposed inside the pipe chamber 4 between the connection of the outlet piece 7 to the sewer pipe 8 and the free end of the suction piece 2. The fluid tank 11 of the fluid tank valve 3 is implemented as a portion of the pipe chamber 4, where said fluid tank 11 comprises a suction opening 15 and an outlet opening 13, with a closing means 10 being hermetically connected to said suction opening 15. The closing means 10 comprises a free end at the downstream extremity thereof, said free end submerging into the fluid 12 located inside the fluid tank 11. Pressure difference causes the closing means 10 to rise from the fluid and produce direct connection between the spaces of the toilet bowl and the sewer pipe. To provide communication between the fluid 12 and the suction opening 15 a levelling pipe 16 is disposed in the fluid tank 11. A float 14 prevents the fluid 12 from escaping through the outlet opening 13 of the fluid tank 11.

As it can be clearly seen in FIG. 1, due to the suction effect of the fan 5 driven by the electric motor 6, bad odour laden air is passed through the suction piece 2 (connected to the flush pipe 1 of the toilet bowl 9) and the open fluid tank valve 3 into the pipe chamber 4 and further through the outlet piece 7 into the sewer pipe 8. Pressure difference causes the closing means 10, located in the fluid tank 11 and connected hermetically to the suction opening 15, to rise from the fluid 12 and thereby connection is established between the spaces of the toilet bowl 9 and the sewer pipe 8. After the source of bad odour has been removed, the electric motor 6 and fan 5 are stopped and the closing means 10 of the fluid tank valve 3 returns into the original submerged (closed) state so as to prevent the air of the sewer pipe 8 from getting back into the toilet cubicle. When the toilet is flushed, water flows from the flush pipe 1 into the fluid tank 11 of the fluid tank valve 3 through the suction piece 2 to compensate for water that may have evaporated. With rising water levels in the fluid tank 11 the float 14 also rises and closes the outlet opening 13, preventing water outflow through said outlet opening 13. After flushing has been completed, excess water reflows into the toilet bowl 9 first through levelling pipe 16 and closing means 10, then through flush pipe 1. With the fluid level returning to its normal value, float 14 follows the level of the fluid and gradually opens the outlet opening 13, which results in the suction effect increasing continuously and finally reaching the normal value.

One of the great advantages of the inventive odour extraction system is that it prevents the air of the cubicle form getting polluted and increases the comfort of the facility. Because the outlet piece is hermetically joined to the end of the sewer pipe, the airtight and fluid-tight joint prevents gases from escaping from the sewer pipe into the environment. Simultaneously with the stopping of the fan the fluid tank valve closes the pipe chamber (more particularly, the connection between the sewer pipe and the suction piece) in order to ensure that gases from the sewer pipe cannot pass through the suction piece and into the space of the cubicle.

While the comfort of toilets has been increasing with the progress of civilization, the problem caused by bad odours has not yet been solved. The odour extraction system with fluid tank valve that is described in the present invention ensures that bad odours are removed from the toilet bowl into the drainage system before entering the space of the cubicle, and also prevents bad odour laden air from reflowing from the sewer pipe. The aim of the invention, providing toilet cubicles with clean air for a prolonged period of time, is thereby accomplished.

List of References

1. flush pipe
2. suction piece
3. fluid tank valve
4. pipe chamber
5. fan
6. electric motor
7. outlet piece
8. sewer pipe
9. toilet bowl
10. closing means
11. fluid tank
12. fluid
13. outlet opening
14. float
15. suction opening
16. levelling pipe

The invention claimed is:

1. An odor extraction system comprising a fluid tank valve, primarily for extracting malodorous air from a toilet bowl and preventing bad odors from getting into the environment, comprising a fan driven by an electric motor, said fan being disposed in a pipe chamber that is located between the free end of a suction piece and an outlet piece, where said suction piece is adapted for connecting to the flush pipe of the toilet bowl and where said outlet piece is hermetically joined to the sewer pipe, with said pipe chamber comprising a fluid tank valve adapted for airtight closure, characterized by that the fluid tank valve is implemented as part of the pipe chamber, the fluid tank of the fluid tank valve contains a liquid and comprises a suction opening and an outlet opening, with a closing member being joined to said suction opening, said closing member having a free end at downstream extremity thereof, with said free end submerging into the liquid in the fluid tank to close the fluid tank valve, with said free end rising from said liquid under the effect of pressure difference caused by the rotation of the fan to open the fluid tank valve and transfer air from the toilet bowl through the fluid tank valve and to the sewer pipe.

2. The odor extraction system according to claim 1, characterized by the fluid tank thereof further comprising a leveling pipe providing communication between the liquid in the fluid tank and the suction opening and a float for preventing the outflow of the liquid in the fluid tank through the outlet opening.

* * * * *